US008575845B2

(12) United States Patent
Hagan et al.

(10) Patent No.: US 8,575,845 B2
(45) Date of Patent: Nov. 5, 2013

(54) METHOD AND APPARATUS TO MEASURE LIGHT INTENSITY

(75) Inventors: Tobin D. Hagan, Plano, TX (US); David L. Freeman, McKinney, TX (US); Marco Corsi, Parker, TX (US)

(73) Assignee: Texas Instruments Incorporated, Dallas, TX (US)

( * ) Notice: Subject to any disclaimer, the term of this patent is extended or adjusted under 35 U.S.C. 154(b) by 166 days.

(21) Appl. No.: 13/325,934

(22) Filed: Dec. 14, 2011

(65) Prior Publication Data

US 2013/0154483 A1 Jun. 20, 2013

(51) Int. Cl.
*H05B 37/02* (2006.01)
*H05B 37/00* (2006.01)

(52) U.S. Cl.
USPC ..... 315/122; 315/186

(58) Field of Classification Search
USPC ..... 315/121, 122, 186, 193, 294, 297, 302, 315/307
See application file for complete search history.

(56) References Cited

U.S. PATENT DOCUMENTS

| | | | | |
|---|---|---|---|---|
| 6,400,101 | B1 * | 6/2002 | Biebl et al. | 315/291 |
| 7,919,936 | B2 * | 4/2011 | Liu et al. | 315/307 |
| 2006/0072319 | A1 | 4/2006 | Dziekan et al. | |
| 2010/0033109 | A1 * | 2/2010 | Liu et al. | 315/294 |
| 2012/0319609 | A1 * | 12/2012 | Choi et al. | 315/210 |

FOREIGN PATENT DOCUMENTS

WO WO03083818 10/2003

* cited by examiner

*Primary Examiner* — Daniel D Chang
(74) *Attorney, Agent, or Firm* — John R. Pessetto; W. James Brady; Frederick J. Telecky, Jr.

(57) ABSTRACT

A method for controlling a light emitting diode (LED) is provided. Initially, the LED, which had been active, is deactivated, and a voltage for a current that corresponds to the persistence of the LED is generated. The voltage is then integrated so as to generate an integrated voltage, and the integrated voltage is compared to a threshold. When the integrated voltage is less than the threshold, the LED is then activated.

13 Claims, 2 Drawing Sheets

METHOD AND APPARATUS TO MEASURE LIGHT INTENSITY

TECHNICAL FIELD

The invention relates generally to light emitting diodes (LEDs) and, more particularly, to using LEDs to measure light intensity.

BACKGROUND

Turning to FIG. 1, an example of a conventional illumination circuit 100 can be seen. In operation, the controller 104 provides a pulse width modulation (PWM) signal PWM1 to transistor Q1 (which, for example, is an NMOS transistor) so as to gate the transistor Q1. When activated, a regulated voltage source (which is represented as voltage VIN) provides a current that flows through the LED string 102 (which is generally comprised of LEDs D1 to DN coupled in series with one another) and resistor R1 (which can function, at least in part, as a current limiting resistor). By adjusting the PWM signal PWM1, the intensity of the emitted light from the LED string 102 can be varied, and this adjustment to the PWM signals PWM1 can be done in response to a measurement from photodiode PD. There are some problems with this arrangement, however; namely, use of the photodiode PD can substantially increase the cost and complexity of the illumination circuit 100. Thus, there is a need for an improved illumination circuit.

Some examples of conventional circuits are: U.S. Patent Pre-Grant Publ. No. 2006/0072319; and PCT Publ. No. WO2003083818.

SUMMARY

An embodiment of the present invention, accordingly, provides an apparatus. The apparatus comprises a plurality of light emitting diodes (LEDs) coupled in series with one another; a pulse width modulation (PWM) switch that is coupled to at least one of the LEDs; and a controller having: a sample switch that is coupled to at least one of the LEDs; a measurement circuit that is coupled to the sample switch; a sample-and-hold (S/H) circuit that is coupled to the measurement circuit; an integrator that is coupled to the S/H circuit; and a PWM generator that is coupled to the integrator, the PWM switch, and the sample switch, wherein the PWM generator controls the PWM and sample switches.

In accordance with an embodiment of the present invention, the PWM generator further comprises: a comparator that is coupled to the integrator; a logic circuit that is coupled to the comparator, the PWM switch, and the sample switch; and a signal generator that is coupled to the integrator, the comparator, and the logic circuit.

In accordance with an embodiment of the present invention, the logic circuit further comprises: a logic gate that is coupled to the comparator and the comparator; a latch that is coupled to the logic gate, the signal generator, and the sample switch; and an inverter that is coupled between the latch and the PWM switch.

In accordance with an embodiment of the present invention, the controller provides a reference signal to the integrator, a sawtooth signal to the comparator, a reset signal to the logic gate, and a sample set signal to the latch.

In accordance with an embodiment of the present invention, the logic gate is a NAND gate.

In accordance with an embodiment of the present invention, the latch is a reset-set (RS) latch.

In accordance with an embodiment of the present invention, the measurement circuit further comprises: a resistor that is coupled to the sample switch; and an amplifier that is coupled to the resistor.

In accordance with an embodiment of the present invention, a method is provided. The comprises deactivating an LED; generating a voltage from a current that corresponds to the persistence of the LED; integrating the voltage so as to generate an integrated voltage; comparing the integrated voltage to a threshold; and activating the LED once the integrated voltage is less than the threshold.

In accordance with an embodiment of the present invention, the LED further comprises a plurality of LEDs, and wherein the step of measuring further comprises measuring the voltage that corresponds to the persistence of at least one of the LEDs.

In accordance with an embodiment of the present invention, the threshold is a sawtooth signal.

In accordance with an embodiment of the present invention, the step of deactivating further comprises: generating a sample pulse; and deactivating the plurality of LEDs in response to the sample pulse.

In accordance with an embodiment of the present invention, the voltage is a cycle voltage for the period between the deactivation and activation of the plurality of LEDs, and wherein the step of generating the voltage further comprises: activating a measuring circuit in response to the sample pulse; and sampling-and-holding the cycle voltage so as to generate an average voltage; and wherein the step of integrating further comprises integrating the average voltage.

In accordance with an embodiment of the present invention, the step of activating further comprises: generating a reset pulse in synchronization with the sample pulse; logically combining the reset pulse with the result of the step of comparing; and deactivating the measurement circuit.

In accordance with an embodiment of the present invention, the step of logically combining further comprises NANDing the reset pulse with the result of the step of comparing.

In accordance with an embodiment of the present invention, an apparatus is provided. The apparatus comprises means for deactivating a plurality of LEDs; means for generating a voltage from a current that corresponds to the persistence of at least one of the LEDs; means for integrating the voltage so as to generate an integrated voltage; means for comparing the integrated voltage to a threshold; and means for activating the LED once the integrated voltage is less than the threshold.

In accordance with an embodiment of the present invention, the threshold is a sawtooth signal.

In accordance with an embodiment of the present invention, the means for deactivating further comprises: means for generating a sample pulse; and means for deactivating the plurality of LEDs in response to the sample pulse.

In accordance with an embodiment of the present invention, the voltage is a cycle voltage for the period between the deactivation and activation of the plurality of LEDs, and wherein the means for generating the voltage further comprises: means for activating a measuring circuit in response to the sample pulse; and means for sampling-and-holding the cycle voltage so as to generate an average voltage; and wherein the step of integrating further comprises integrating the average voltage.

In accordance with an embodiment of the present invention, the means for activating further comprises: means for generating a reset pulse in synchronization with the sample pulse; means for logically combining the reset pulse with the result of the step of comparing; and means for deactivating the measurement circuit.

In accordance with an embodiment of the present invention, the means for logically combining further comprises means for NANDing the reset pulse with the result of the step of comparing.

In accordance with an embodiment of the present invention,

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 3:
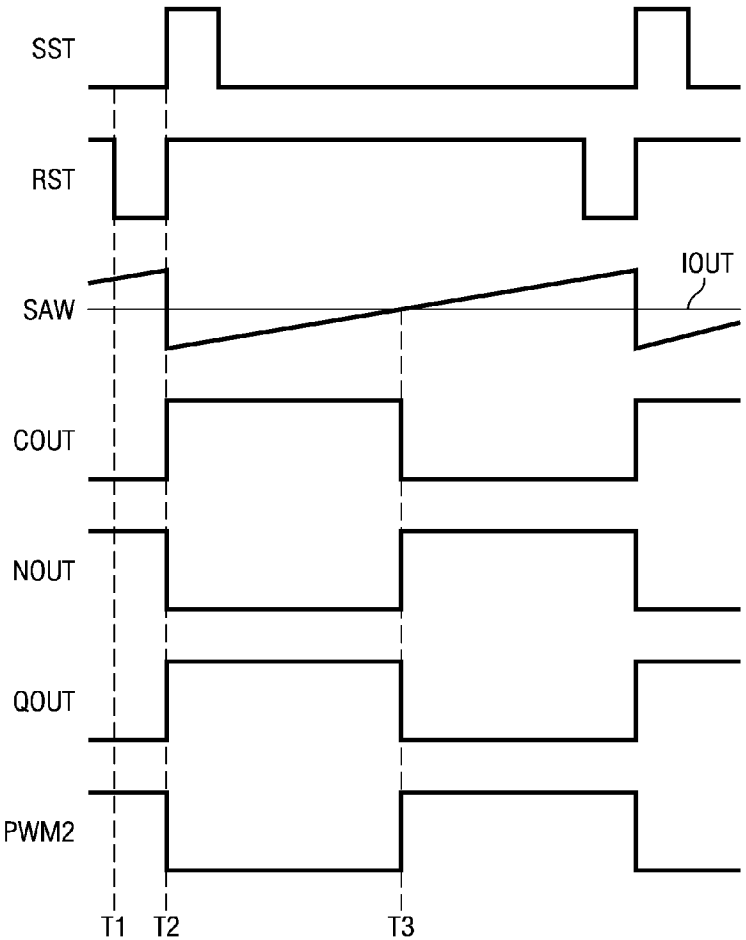
FIG. 3 is a diagram depicting the operation of the circuit of FIG. 3.
Figure 1:
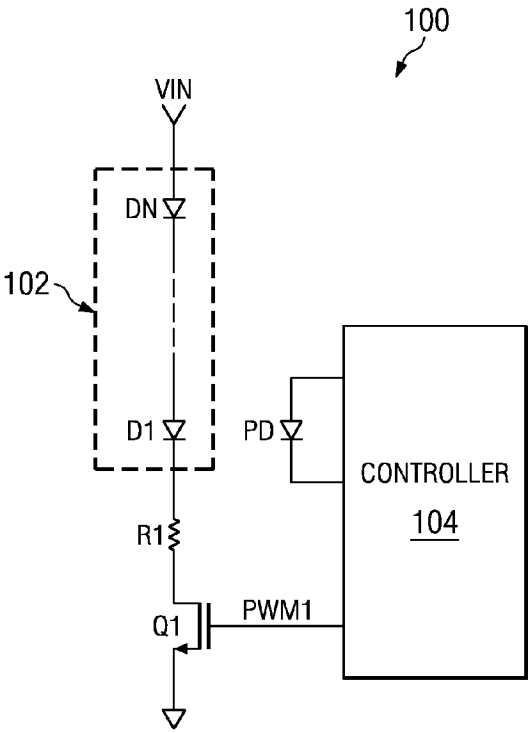
FIG. 1 (PRIOR ART)
FIG. 1 is a diagram of an example of a conventional illumination circuit.

Refer now to the drawings wherein depicted elements are, for the sake of clarity, not necessarily shown to scale and wherein like or similar elements are designated by the same reference numeral through the several views.

Figure 2:
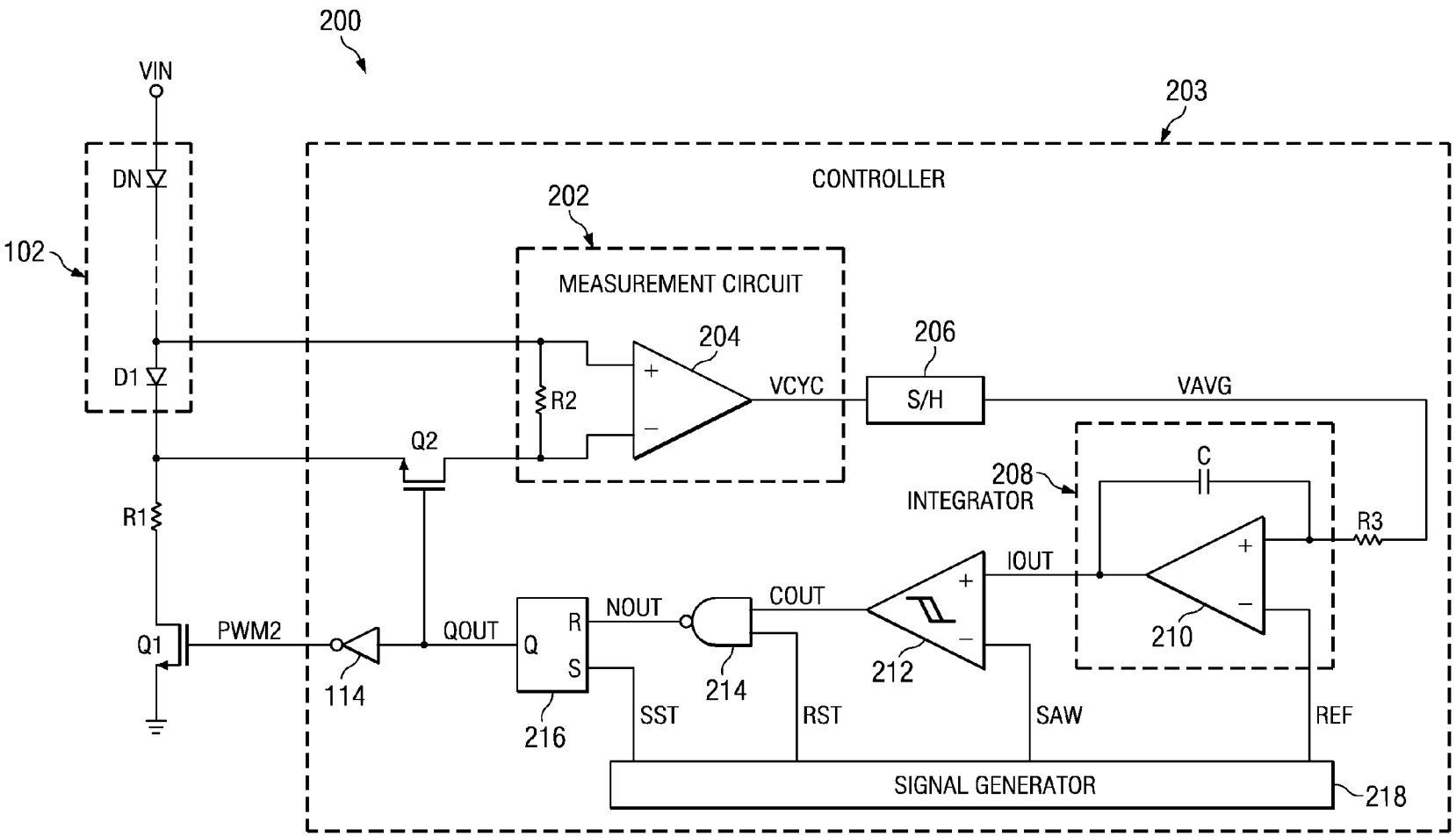
FIG. 2 is a diagram of an example of an illumination circuit in accordance with the present invention.

Turning to FIGS. 2 and 3, an example of an illumination circuit 200 in accordance with the present invention can be seen. As shown, circuit 200 includes LED string 102, resistor R1, and transistor Q1 (which generally operates as a switch), similar to circuit 100. The LED string 102 may also include "white light" LEDs or white LEDs as LEDs D1 to DN. Typically, white light LEDs are generally comprised of a semiconductor element (which can, for example, be formed of InGaN, ZnSe, or SiC) and a lens. The semiconductors usually generate blue light (having a wavelength between about 450 nm and about 475 nm), and the lens (which generally includes a yellow phosphor and which is generally formed of an epoxy) is able to absorb the blue light and retransmit white light. When the white LEDs are switched from "on" to "off," the yellow phosphor (which can, for example, be cerium-doped yttrium aluminum garnet or $Ce^{+3}$: YAG) in the lens will continue to "glow" for a short time (i.e., 1 μs). This "glowing" after the white LED is switched "off" is known as persistence, and the intensity and duration of the persistence is related to the strength of the semiconductor (i.e., InGaN) or the intensity of the emitted blue light. Circuit 200 can then take advantage of this property (persistence) that exists with many white light LEDs to make intensity measurements.

To be able to take advantage of this property, the controller 203 uses the semiconductor as photodiode while the LED (i.e., LED1) is "glowing." At time T1 of the example shown in FIG. 3, the signal generator 218 transitions the reset signal RST from logic high or "1" to logic low or "0." This causes the NAND gate 214 to output a "0" to the reset or R terminal of latch 216 (which, as shown in this example, is a reset-set or RS latch) and forces the Q terminal of latch 216 to be logic low. At time T2 in this example, signal generator 218 transitions the reset signal RST back to logic high and generates a sample pulse (which is part of the sample signal SST) in synchronization with the reset signal RST. This sample pulse is usually set to its narrowest allowable width, but can be adjusted as desired. The signal generator 218 also forces the sawtooth signal SAW to its most negative value in synchronization with the reset signal RST at time T2. Because the sawtooth signal SAW is at its most negative value at time T2, integrated voltage IOUT from integrator 210 (which is generally comprised of amplifier 210, capacitor C, and resistor R3) is greater than the sawtooth signal SAW, so the comparator 212 outputs a "1" as its output signal COUT. Since the reset signal RST and the output signal COUT are both "1", the NAND gate 214 generates a "0" as its output signal NOUT to the R terminal of latch 216. The latch 216 then outputs a "1" as signal QOUT at its Q terminal because signal SST is "1" and signal NOUT is "0." When signal QOUT is "1", inverter 114 deactivates PWM switch or transistor Q1 (shutting off LED string 102), and latch 216 activates sample transistor or switch Q2 (which can, for example, be an NMOS transistor). Once transistor Q2 is activated, the measurement circuit 202 (which is generally comprised of resistor R2 and amplifier 204) is able to measure current from LED D1 (where the current from multiple LEDs can be done as well) to generate the voltage VCYC (which can be referred to as a cycle voltage) that results from the "glowing" of LED D1. Sample-and-hold (S/H) circuit 206 then receives the cycle voltage VCYC so as to average it with cycle voltages from previous cycles and generate average voltage VAVG. Integrator 208 then integrates the average voltage VAVG to generate integrated voltage IOUT. Once the threshold (i.e., sawtooth signal SAW) reaches the integrated voltage IOUT at time T3, signal GOUT transitions back to "0," turning the LED string 102 back "on." This cycle is then repeated over multiple cycles.

As shown in the examples of FIGS. 2 and 3, intensity from string 102 is a function of the timing of the signals RST and SST, the shape and timing of signal SAW, and the level of reference voltage REF (which is used by the integrator 208), and these signals, RST, SST, SAW, and REF, may be adjusted by a user to achieve a desired level of light intensity. Because of the configuration of circuit 200, the intensity of light emitted as set by the user from string 102 can be maintained over long periods of time without using an additional photodiode.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a plurality of light emitting diodes (LEDs) coupled in series with one another;

a pulse width modulation (PWM) switch that is coupled to at least one of the LEDs; and a controller having:

a sample switch that is coupled to at least one of the LEDs;

a measurement circuit that is coupled to the sample switch;

a sample-and-hold (S/H) circuit that is coupled to the measurement circuit;

an integrator that is coupled to the S/H circuit; and a PWM generator that is coupled to the integrator, the PWM switch, and the sample switch, wherein the PWM generator controls the PWM and sample switches.

2. The apparatus of claim 1, wherein the PWM generator further comprises:

a comparator that is coupled to the integrator;

a logic circuit that is coupled to the comparator, the PWM switch, and the sample switch; and a signal generator that is coupled to the integrator, the comparator, and the logic circuit.

3. The apparatus of claim 2, wherein the logic circuit further comprises:

a logic gate that is coupled to the comparator and the comparator;

a latch that is coupled to the logic gate, the signal generator, and the sample switch; and an inverter that is coupled between the latch and the PWM switch.

4. The apparatus of claim 3, wherein the controller provides a reference signal to the integrator, a sawtooth signal to the comparator, a reset signal to the logic gate, and a sample set signal to the latch.

5. The apparatus of claim 4, wherein the logic gate is a NAND gate.

6. The apparatus of claim 5, wherein the latch is a reset-set (RS) latch.

7. The apparatus of claim 6, wherein the measurement circuit further comprises:

a resistor that is coupled to the sample switch; and an amplifier that is coupled to the resistor.

8. A method comprising:

deactivating an LED;

generating a voltage from a current that corresponds to the persistence of the LED;

integrating the voltage so as to generate an integrated voltage;

comparing the integrated voltage to a threshold; and activating the LED once the integrated voltage is less than the threshold;

wherein the LED further comprises a plurality of LEDs, wherein a step of measuring further comprises measuring the voltage that corresponds to the persistence of at least one of the LEDs;

wherein the threshold is a sawtooth signal;

wherein the step of deactivating further comprises:

generating a sample pulse; and deactivating the plurality of LEDs in response to the sample pulse;

wherein the voltage is a cycle voltage for the period between the deactivation and activation of the plurality of LEDs, and wherein the step of generating the voltage further comprises:

activating a measuring circuit in response to the sample pulse; and sampling-and-holding the cycle voltage so as to generate an average voltage;

and wherein the step of integrating further comprises integrating the average voltage.

9. The method of claim 8, wherein the step of activating further comprises:

generating a reset pulse in synchronization with the sample pulse;

logically combining the reset pulse with the result of the step of comparing; and deactivating the measurement circuit.

10. The method of claim 9, wherein the step of logically combining further comprises NANDing the reset pulse with the result of the step of comparing.

11. An apparatus comprising:

means for deactivating a plurality of LEDs;

means for generating a voltage from a current that corresponds to the persistence of at least one of the LEDs;

means for integrating the voltage so as to generate an integrated voltage;

means for comparing the integrated voltage to a threshold; and means for activating the LED once the integrated voltage is less than the threshold;

wherein the threshold is a sawtooth signal;

wherein the means for deactivating further comprises:

means for generating a sample pulse; and means for deactivating the plurality of LEDs in response to the sample pulse;

wherein the voltage is a cycle voltage for the period between the deactivation and activation of the plurality of LEDs, and wherein the means for generating the voltage further comprises:

means for activating a measuring circuit in response to the sample pulse; and means for sampling-and-holding the cycle voltage so as to generate an average voltage; and wherein the step of integrating further comprises integrating the average voltage.

12. The apparatus of claim 11, wherein the means for activating further comprises:

means for generating a reset pulse in synchronization with the sample pulse;

means for logically combining the reset pulse with the result of the step of comparing; and means for deactivating the measurement circuit.

13. The apparatus of claim 12, wherein the means for logically combining further comprises means for NANDing the reset pulse with the result of the step of comparing.

* * * * *